US010058972B2

(12) United States Patent
Zurbruegg et al.

(10) Patent No.: US 10,058,972 B2
(45) Date of Patent: Aug. 28, 2018

(54) MACHINE TOOL CLAMPING DEVICE

(75) Inventors: Andreas Zurbruegg, Luterbach (CH); Urs Roth, Flumenthal (CH)

(73) Assignee: Robert Bosch GmbH, Stuttgart (DE)

( * ) Notice: Subject to any disclaimer, the term of this patent is extended or adjusted under 35 U.S.C. 154(b) by 499 days.

(21) Appl. No.: 14/352,207

(22) PCT Filed: Sep. 4, 2012

(86) PCT No.: PCT/EP2012/067162

§ 371 (c)(1),
(2), (4) Date: Jul. 15, 2014

(87) PCT Pub. No.: WO2013/056890

PCT Pub. Date: Apr. 25, 2013

(65) Prior Publication Data

US 2014/0323019 A1 Oct. 30, 2014

(30) Foreign Application Priority Data

Oct. 17, 2011 (DE) ..... 10 2011 084 591

(51) Int. Cl.
*B24B 23/04* (2006.01)

(52) U.S. Cl.
CPC ..... *B24B 23/046* (2013.01)

(58) Field of Classification Search
CPC ..... B24B 23/046
See application file for complete search history.

(56) References Cited

U.S. PATENT DOCUMENTS

| | | | | | |
|---|---|---|---|---|---|
| 2,712,206 | A * | 7/1955 | Champayne | 451/491 |
| 2,795,901 | A * | 6/1957 | Mosbacher | 451/356 |
| 2,914,889 | A * | 12/1959 | Mosbacher | 451/516 |
| 2,918,761 | A * | 12/1959 | Earl et al. | 451/357 |
| 3,657,844 | A * | 4/1972 | Mogaki | 451/357 |
| 4,077,165 | A * | 3/1978 | Hutchins | 451/518 |
| 4,351,133 | A * | 9/1982 | Stoll et al. | 451/490 |
| 4,625,462 | A * | 12/1986 | Fushiya et al. | 451/357 |
| 8,251,781 | B2 * | 8/2012 | Hagiwara | 451/356 |

FOREIGN PATENT DOCUMENTS

| | | | |
|---|---|---|---|
| CN | 1190364 | A | 8/1998 |
| CN | 1464812 | A | 12/2003 |
| CN | 1464813 | A | 12/2003 |
| CN | 1882415 | A | 12/2006 |
| CN | 101184581 | A | 5/2008 |
| DE | 103 23 640 | A1 | 12/2004 |
| RU | 2 107 608 | C1 | 3/1998 |

OTHER PUBLICATIONS

International Search Report corresponding to PCT Application No. PCT/EP2012/067162, dated Jan. 24, 2013, (German and English language document) (5 pages).

* cited by examiner

*Primary Examiner* — Marc Carlson

(74) *Attorney, Agent, or Firm* — Maginot, Moore & Beck LLP

(57) ABSTRACT

A machine tool clamping device for clamping a laminar machining tool to a tool holder that is eccentrically movably mounted includes at least one clamping unit with at least one movably mounted clamping element. The machine tool clamping device also includes at least one slotted link movement unit configured to move the clamping element in at least one operating state so as to generate tensile stress in the laminar machining tool.

10 Claims, 6 Drawing Sheets

MACHINE TOOL CLAMPING DEVICE

This application is a 35 U.S.C. § 371 National Stage Application of PCT/EP2012/067162, filed on Sep. 4, 2012, which claims the benefit of priority to Serial No. DE 10 2011 084 591.7, filed on Oct. 17, 2011 in Germany, the disclosures of which are incorporated herein by reference in their entirety.

BACKGROUND

There are already known power tool clamping devices for clamping a sheet-type working tool to a tool receiver that is mounted in an eccentrically movable manner, which comprise a clamping unit that has a movably mounted clamping element.

SUMMARY

The disclosure is based on power tool clamping device for clamping a sheet-type working tool to a tool receiver that is mounted in an eccentrically movable manner, comprising at least one clamping unit, which has at least one movably mounted clamping element.

It is proposed that the power tool clamping device comprise at least one slotted link movement unit, which is provided to move the clamping element for the purpose of generating a tension in the sheet-type working tool, in at least one operating state. The expression "sheet-type" is intended here to define, in particular, a geometric form of a component, wherein the component has a material thickness that, in particular, is less than 10 mm, preferably less than 5 mm, and particularly preferably greater than 1 um. Particularly preferably, the sheet-type working tool is realized as an abrasive sheet, or as abrasive paper. The working tool thus preferably has, at least on one face, a coating of an abrasive means that is provided to remove workpiece particles from a surface of a workpiece when work is performed on the workpiece. "Movably mounted" is to be understood here to mean, in particular, a mounting of a component relative to another component, wherein the tool receiver, in particular dissociated from an elastic deformation of the component, has a capability to move along at least one axis, along a travel distance greater than 1 mm, preferably greater than 5 mm, and particularly preferably greater than 10 mm, and/or has a capability to move about at least one axis, by an angle greater than 1°, preferably greater than 2°, and particularly preferably greater than 5°. The tool receiver is, in particular, mounted on the housing unit so as to be eccentrically movable relative to a housing unit of a portable power tool. Preferably, the portable power tool comprises the tool receiver. Particularly preferably, the tool receiver is realized as a swing plate, to which the sheet-type working tool can be clamped by means of the power tool clamping device according to the disclosure. A "clamping unit" is to be understood here to mean, in particular, a unit that, by means of a form closure and/or by means of a force closure, secures the working tool to and/or on the tool receiver for the purpose of performing work on the workpiece, in order to transmit movements of the tool receiver to the working tool. The clamping element is preferably realized as a binding element. "Provided" is to be understood to mean, in particular, specially designed and/or specially equipped.

A "slotted link movement unit" is to be understood here to mean, in particular, a unit that, by combined action of at least two slotted link movement elements that are disposed so as to be movable relative to each other, in particular a slotted link guideway and a slotted link engagement element that engages in the slotted link guideway, moves a component, in particular the clamping element, in particular in a movement direction that differs from a movement direction of at least one slotted link movement element. Preferably, by means of the slotted link movement unit, one type of movement such as, for example, a translation and/or a rotation, of at least one slotted link movement element is converted into a type of movement of the clamping element that differs from the type of movement of the at least one slotted link movement element. The slotted link movement unit thus preferably causes the clamping unit to execute a type of movement that differs from a type of movement of at least one slotted link movement element. Preferably, the slotted link movement unit defines a movement path of the component, along which the component is moved by the combined action of the slotted link movement elements, wherein the component is guided, at least partially, during the movement by the combined action of the slotted link movement elements. Preferably, in at least one operating state, the movement of the clamping element by means of the slotted link movement unit alters a tension in the sheet-type working tool clamped to the tool receiver, in particular in addition to a pure clamping-in of at least one end of the sheet-type working tool. The design according to the disclosure makes it possible, advantageously, to achieve taughtness of the sheet-type working tool. Advantageously, therefore, movement of the sheet-type working tool relative to the tool receiver during execution of work upon a workpiece can be prevented as far as possible, or reduced to a minimum. Advantageously, a work result of high quality can be achieved. In addition, advantageously, a high degree of operating convenience can be achieved in clamping the sheet-type working tool to the tool receiver.

Furthermore, it is proposed that at least one slotted link movement element of the slotted link movement unit be disposed on the clamping element. Preferably, the slotted link movement element is realized as a slotted link guideway. It is also conceivable, however, for the slotted link movement element to be realized as a slotted link engagement element, such as, for example, a slotted link pin that engages in the slotted link guideway. The slotted link movement element in this case may be realized as a slot-type axial extension that is constituted, for example, by two convergent ribs, webs, etc., wherein the axial extension has edge regions whose courses form a slotted link guideway. In addition, the slotted link movement element may be realized as a recess, wherein a course of an edge region delimiting the recess forms a slotted link guideway. Other designs considered appropriate by persons skilled in the art are also conceivable. Preferably, the slotted link movement element is realized so as to be integral with the clamping element. "Integral with" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. The design according to the disclosure makes it possible, by simple design means, to realize a movement of the clamping element by means of the slotted link movement unit. Moreover, advantageously, a compact arrangement of the slotted link movement unit can be achieved.

It is additionally proposed that the slotted link movement unit have at least one further slotted link movement element, which is disposed on an operating element of the clamping unit. Preferably, the further slotted link movement element is realized as a slotted link pin that engages in the slotted link movement element that is realized as a slotted link guideway. It is also conceivable, however, for the further slotted link movement element to be realized as a slotted link guideway, in which there engages a slotted link movement element realized as a slotted link pin. The further slotted link movement element may be realized so as to be integral with the operating element, or fixed to the operating element by means of a form-closure and/or force-closure connection. It is additionally conceivable, in an alternative design, for the slotted link movement unit to comprise two further slotted link movement elements, realized as slotted link pins, which engage in a slotted link movement element of the slotted link movement unit that is realized as a recess. In the alternative design, the two further slotted link movement elements realized as slotted link pins each respectively bear against an edge region of the slotted link movement element realized as a recess, wherein, upon a movement of the operating element, the two further slotted link movement elements realized as slotted link pins slide on the edge regions and thus move the clamping element. By means of the design according to the disclosure, a movement of the operating element, in particular as a result of the further slotted link movement element acting in combination with the slotted link movement element disposed on the clamping element, can advantageously be converted by the slotted link movement unit into a movement of the clamping element.

Advantageously, the operating element is realized as a pivotally mounted operating lever. An "operating lever" is to be understood here to mean, in particular, a rotatably mounted operating element of the operating unit that, perpendicularly in relation to a rotation axis, has at least one lever element, the lever element having a longitudinal extent that is at least twice as great as at least one other extent perpendicularly in relation to a rotation axis. It is also conceivable, however, for the operating element to be of a another design considered appropriate by persons skilled in the art, such as, for example, designed as a rotary knob, etc. Particularly preferably, the operating element is mounted so as to be pivotable about a substantially perpendicularly in relation to a working tool seating face of the tool receiver. In this case, the operating element is preferably mounted so as to be pivotable relative to the tool receiver. When the tool receiver has been mounted, the working tool seating face of the tool receiver is disposed on a side of the tool receiver that faces away from the housing unit of the portable power tool. The expression "substantially perpendicularly" is intended here to define, in particular, an alignment of a direction relative to a reference direction, the direction and the reference direction, in particular as viewed in one plane, enclosing an angle of 90° and the angle having a maximum deviation of, in particular, less than 8°, advantageously less than 5°, and particularly advantageously less than 2°. Advantageously, a transmission of force can be achieved. A small force exerted upon the operating element by an operator can thus be converted into a large actuating force for the purpose of moving the clamping element.

It is additionally proposed that the clamping element be mounted in a translationally movable manner. Preferably, a movement axis, along which the clamping element is mounted in a translationally movable manner, runs at least substantially parallelwise in relation to the working tool seating face of the tool receiver. It is also conceivable, however, for the clamping element to be mounted so as to be movable along and/or about another movement axis. "Substantially parallelwise" is intended here to mean, in particular, an alignment of a direction relative to a reference direction, in particular in one plane, wherein the direction deviates from the reference direction by, in particular, less than 8°, advantageously less than 5°, and particularly advantageously less than 2°. The design according to the disclosure makes it possible, by simple design means, to achieve a tension in the sheet-type working tool as a result of a movement of the clamping element, in at least one operating state.

Advantageously, the clamping unit has a further clamping element, which is mounted so as to be movable relative to the clamping element. Preferably, in at least one operating state, the sheet-type working tool is clamped in between the clamping element and the further clamping element as a result of a movement of the clamping element relative to the further clamping element. The clamping element and the further clamping element are thus preferably provided to clamp the working tool to and/or on the tool receiver by means of a binding force. Advantageously, the sheet-type working tool can be securely clamped between the clamping element and the further clamping element for the purpose of generating a tension in the sheet-type working tool by means of the slotted link movement unit, as a result of a movement of at least the clamping element, after at least one end of the sheet-type working tool has been clamped-in.

Particularly preferably, the further clamping element is mounted in a translationally movable manner. Preferably, a movement axis, along which the further clamping element is mounted in a translationally movable manner, runs at least substantially parallelwise in relation to the working tool seating face of the tool receiver. In addition, the movement axis, along which the further clamping element is mounted in a translationally movable manner, runs at least substantially parallelwise in relation to the movement axis of the clamping element. It is also conceivable, however, for the further clamping element to be mounted so as to be movable along and/or about another movement axis. A binding mechanism for clamping the sheet-type working tool can be achieved by simple design means.

Furthermore, it is proposed that the clamping unit have at least one spring element, which is provided to apply a spring force to the further clamping element in the direction of the clamping element. A "spring element" is to be understood to mean, in particular, a macroscopic element having at least one extent that, in a normal operating state, can be varied elastically by at least 10%, in particular by at least 20%, preferably by at least 30%, and particularly advantageously by at least 50% and that, in particular, generates a counterforce, which is dependent on the variation of the extent and preferably proportional to the variation and which counteracts the variation. An "extent" of an element is to be understood to mean, in particular, a maximum distance of two points of a perpendicular projection of the element on to a plane. A "macroscopic element" is to be understood to mean, in particular, an element having an extent of at least 1 mm, in particular of at least 5 mm, and preferably of at least 10 mm. By means of the design according to the disclosure it is advantageously possible, in at least one operating state, to achieve a supporting action for generation of a binding force for the purpose of fixing the sheet-type working tool between the clamping element and the further clamping element. By simple design means, it is possible to realize an automatic movement of the further clamping element, in particular upon release of an operating position of the clamping element and the further clamping element, for the purpose of generating a tension in the sheet-type working tool.

Advantageously, the further clamping element is moved by the clamping element against a spring force of a spring element of the clamping unit, at least when in an operating state. Preferably, the clamping element and the further clamping element are moved jointly against a spring force of the spring element, at least in the operating state in which a tension is generated in the sheet-type working tool by means of the slotted link movement unit. Advantageously, a strong binding force can be generated for the purpose of clamping the sheet-type working tool, in order to generate a tension in the sheet-type working tool.

The disclosure is additionally based on a portable power tool comprising a power tool clamping device according to the disclosure. A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Preferably, the power tool is realized as an orbital sander. It is also conceivable, however, for the portable power tool to be of a different design, considered appropriate by persons skilled in the art, such as, for example, designed as a random orbit sander, as an angle grinder, as a delta sander, etc. Advantageously, with the design of the portable power tool according to the disclosure, a high degree of operating comfort can be achieved for an operator of the portable power tool.

The power tool switching device according to the disclosure and/or the power tool according to the disclosure are/is not intended in this case to be limited to the application and embodiment described above. In particular, the power tool switching device according to the disclosure and/or the power tool according to the disclosure may have individual elements, components and units that differ in number from a number stated herein, in order to fulfill a principle of function described herein.

BRIEF DESCRIPTION OF THE DRAWINGS

Further advantages are given by the following description of the drawings. The drawings show an exemplary embodiment of the disclosure. The drawings, the description and the claims contain numerous features in combination. Persons skilled in the art will also expediently consider the features individually and combine them to create appropriate further combinations.

In the drawings.

DETAILED DESCRIPTION

Figure 1:
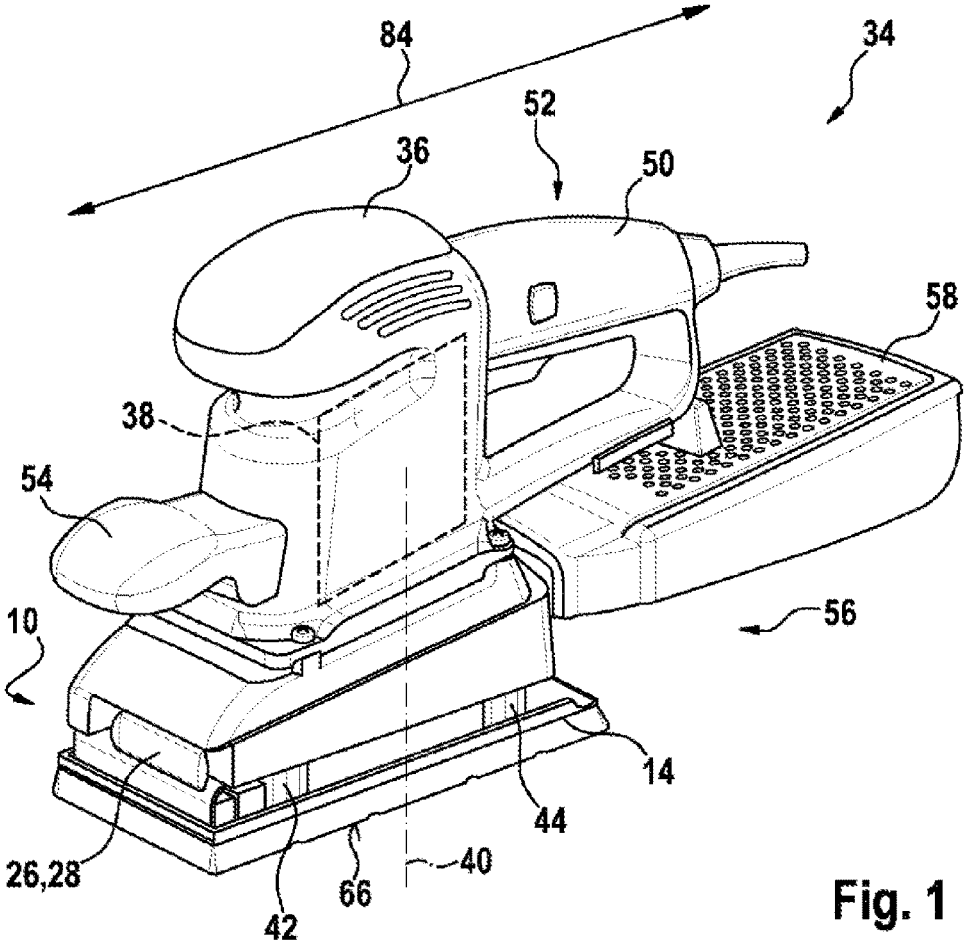
FIG. 1 shows a schematic representation of a portable power tool according to the disclosure, with a power tool clamping device according to the disclosure.

FIG. 1 shows a portable power tool 34, realized as an orbital sander, which comprises a power tool clamping device 10. The portable power tool 34 has a housing unit 36, which encloses a drive unit 38. The drive unit 38 is realized as an electric motor unit. It is also conceivable, however, for the drive unit 38 to be of a different design, considered appropriate by persons skilled in the art, such as, for example, designed as a pneumatic drive unit, etc. The drive unit 38 is provided to drive the tool receiver 14 of the portable power tool 34 in an oscillating manner in a plane, eccentrically about a drive axis 40 of the drive unit 38, in a manner known to persons skilled in the art. The plane in this case is at least substantially perpendicular to the drive axis 40. The drive unit 38 is connected to the tool receiver 14, in a manner known to persons skilled in the art, for the purpose of driving the tool receiver 14 by means of a random orbit transmission (not represented in greater detail here). The tool receiver 14 is additionally mounted on the housing unit 36 by means of elastic oscillation springs 42, 44, 46, 48 (FIG. 2), in a manner already known to persons skilled in the art. For handling of the portable power tool 34 when work is being performed on a workpiece (not represented in greater detail here), the housing unit 36 comprises a main handle 50, disposed on which there is a switching unit 52 for putting the portable power tool 34 into operation. The main handle 50 extends at least substantially along a direction of main extent 84 of the portable power tool 34. The housing unit 36 additionally comprises an ancillary handle 54, for guiding the portable power tool 34 as work is performed on a workpiece. In this case, the ancillary handle 54 is disposed on a side of the housing unit 36 that faces away from the main handle 50, as viewed along the direction of main extent 84. Furthermore, the portable power tool 34 has a dust extraction unit 56, which has a dust collection container 58. The dust collection container 58 is can be removably attached to the portable power tool 34. In this case, the dust extraction unit 56 is of a design already known to persons skilled in the art.

Figure 2:
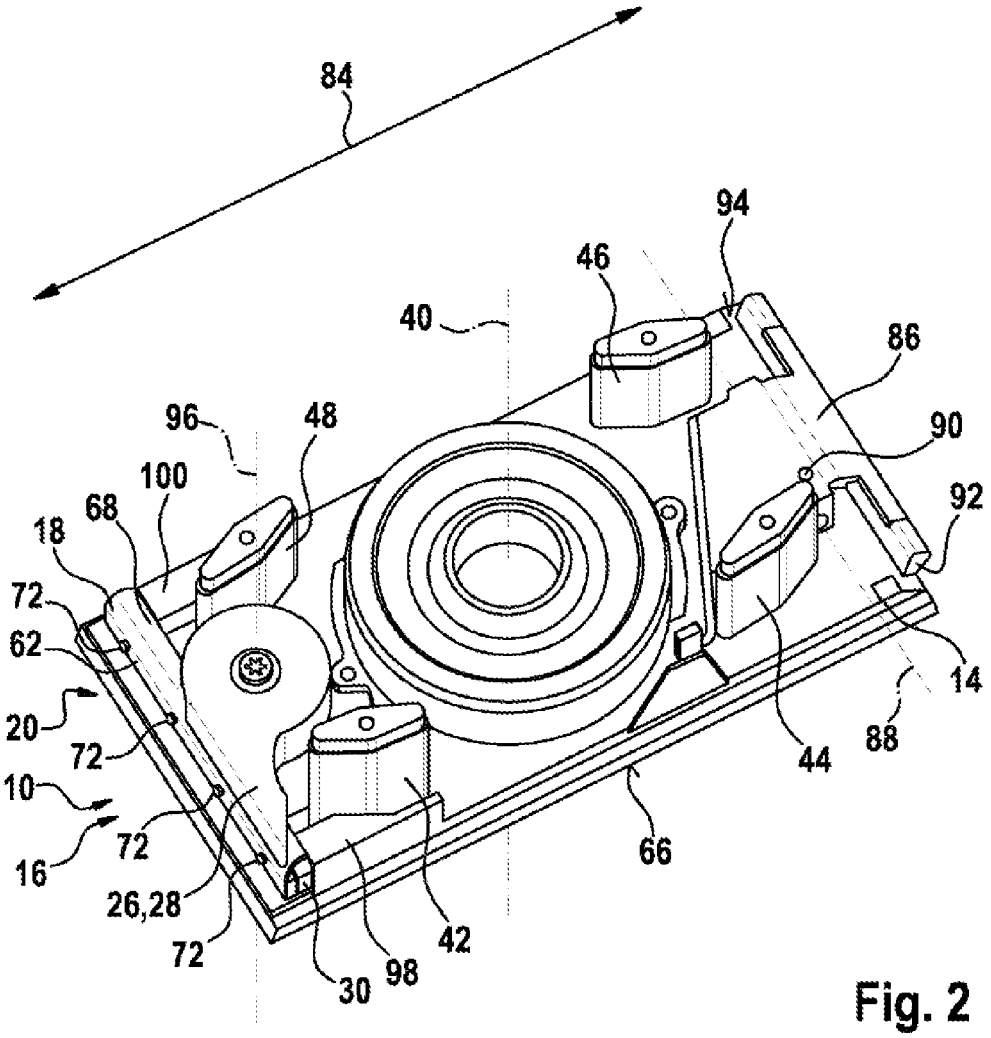
FIG. 2 shows a schematic representation of a detail view of a tool receiver of the portable power tool according to the disclosure, with the mounted power tool clamping device according to the disclosure.

The tool receiver 14, on which the power tool clamping device 10 is disposed, is shown in FIG. 2, demounted from the housing unit 36 of the portable power tool 34. The power tool clamping device 10 is provided for clamping a sheet-type working tool 12 (FIG. 5) to the tool receiver 14, which is mounted in an eccentrically movable manner. The sheet-type working tool 12 is realized as abrasive paper. In this case, the power tool clamping device 10 has at least one clamping unit 16, which has at least one movably mounted clamping element 18. The clamping element 18 is realized as a clamping plate. In this case, the clamping element 18 has a guide region 60 and a binding region 62. The guide region 60 is of a plate-type design. For the purpose of guiding the clamping element 18 during a movement, the guide region 60 is movably mounted in guide grooves 64 of the tool receiver 14. The guide grooves 64 extend at least substantially parallelwise in relation to a working tool seating face 66 of the tool receiver 14. The working tool seating face 66 in this case is constituted by a face of the tool receiver 14 that faces away from the housing unit 36 when the tool receiver 14 is in a mounted state. When work is being performed on a workpiece, the working tool seating face 66, with a working tool 12 disposed thereon, bears on a surface of a workpiece on which work is to be performed. The clamping element 18 is thus mounted on the tool receiver 14 in a translationally movable manner, by means of the guide grooves 64.

The binding region 62 of the clamping element 18 extends at least substantially perpendicularly in relation to the guide region 60. In this case, when the clamping element 18 is in a mounted state, the binding region 62 extends in the direction of the working tool seating surface 66. The clamping element 18 is thus of an L-shaped design, as viewed in a plane running at least substantially perpendicularly in relation to the working tool seating face 66, wherein the guide region 60 and the binding region 62 are connected to each other by means of a transition region of the clamping element 18 that runs at least substantially transversely in relation to an extent of the guide region 60. The transition region 68 in this case is arcuate in form. The guide region 60, the binding region 62 and the transition region 68 of the clamping element 18 are realized as a single piece. It is also conceivable, however, for the guide region 60, the binding region 62 and the transition region 68 to be separate from each other, and to be connected to each other by means of a connecting element considered appropriate by persons skilled in the art. Furthermore, the clamping unit 16 has at least one binding jaw element 70. The binding jaw element 70 is fixed to the clamping element 18 by means of pin-type portions 72. In this case, the binding jaw element 70 is disposed on the binding region 62. The binding jaw element 70 is realized as a plastic element, the sheet-type working tool 12 bearing against it when in a clamped state.

The clamping unit 16 additionally comprises a further clamping element 30, which is mounted so as to be movable relative to the clamping element 18. The further clamping element 30 is likewise mounted in a translationally movable manner. In this case, at least the binding region 62 of the clamping element 18 is disposed in a plane in which the further clamping element 30 is movably mounted. The further clamping element 30 is realized as a binding bar. The binding bar has a binding region 74 and two guide regions 76. The binding region 74 of the further clamping element 30, realized as a binding bar, has a rectangular cross section, as viewed in the plane running at least substantially perpendicularly in relation to the working tool seating face 66. It is also conceivable, however, for the binding region 74 to have a different cross section, considered appropriate by persons skilled in the art. In addition, on a side of the further clamping element 30 that faces toward the clamping element 18, the binding region 74 has web-type binding jaw elements 78, the sheet-type working tool 12 bearing against the latter when in a clamped state. The binding region 74 of the further clamping element 30 is provided, in combination with the binding region 62 of the clamping element 18, to clamp in the sheet-type working tool 12, in at least one operating state.

Figure 3:
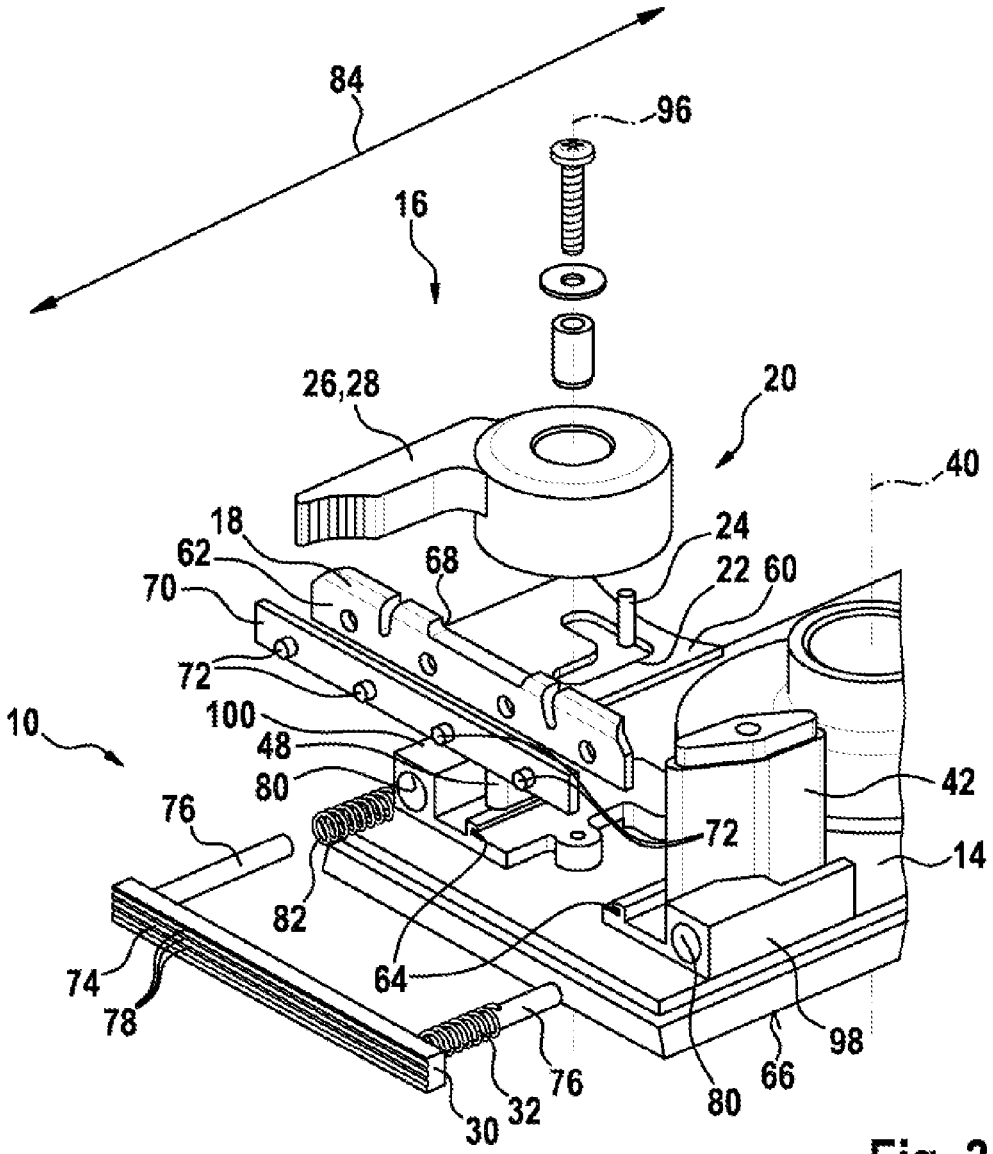
FIG. 3 shows a schematic representation of a further detail view of the tool receiver of the portable power tool according to the disclosure, with the mounted power tool clamping device according to the disclosure.

The guide regions 76 of the further clamping element 30 are realized as pin-type axial extensions, which are formed on to the binding region 74, spaced apart relative to each other (FIG. 3). It is also conceivable, however, for the guide regions 76 of the further clamping element 30 to be of a different design, considered appropriate by persons skilled in the art, and for the guide regions 76 to be realized separately from the binding region 74 and securely fixed to the binding region 74 by means of connecting elements. The guide regions 76 extend at least substantially perpendicularly in relation to a binding face of the binding region 74. In this case, when the further clamping element 30 is in a mounted state, the guide regions 76 extend into guide recesses 80 of the tool receiver 14. The clamping unit 16 has at least one spring element 32, which is provided to apply a spring force to the further clamping element 30 in the direction of the clamping element 18. The clamping unit 16 has a total of two spring elements 32, 82 (FIG. 3). The spring elements 32, 82 are disposed on the guide regions 76. With one end, the spring elements 32, 82 are each respectively supported on a side of the binding region 74 of the further clamping element 30 that faces away from the clamping element 18 and, with another end, the spring elements 32, 82 are each respectively supported on a collar of the tool receiver 14, each collar being disposed in a respective guide recess 80. By means of securing elements (not represented in greater detail here), the further clamping element 30 is secured against falling out, i.e. the guide regions 76 of the further clamping element 30 are secured against moving out of the guide recesses 80 of the tool receiver 14.

Furthermore, the clamping unit 16 has a counter-clamping element 86, which is provided to clamp an end of the sheet-type working tool 12 that faces away from the clamping element 18 and the further clamping element 30. The counter-clamping element 86 in this case is disposed on a side of the tool receiver 14 that faces away from the clamping element 18 and the further clamping element 30, as viewed along the direction of main extent 84. In this case, the counter-clamping element 86 is mounted so as to be pivotable about a pivot axis 88 of the counter-clamping element 86, relative to the tool receiver 14. When the tool receiver 14 is in a mounted state, the swivel axis 88 runs in a plane that extends at least substantially parallelwise in relation to the working tool seating face 66, at least substantially perpendicularly in relation to the drive axis 40 of the drive unit 38. A spring force is applied to the counter-clamping element 86, in the direction of the tool receiver 14, by means of a further spring element 90 of the clamping unit 16. The further spring element 90 is realized as a torsion spring, or as a leg spring. It is also conceivable, however, for the further spring element 90 to be of a different design, considered appropriate by persons skilled in the art, such as, for example, as a tension spring or as coil spring realized as a compression spring, etc. The clamping unit 16 additionally has a further binding jaw element 92, which is disposed on the counter-clamping element 86. When in a clamped state, the end of the sheet-type working tool 12 that faces away from the clamping element 18 and the further clamping element 30 is clamped in between the further binding jaw element 92 and a binding face 94 of the tool receiver 14, in a manner known to persons skilled in the art. In this case, the binding jaw element 92 is realized as a plastic element.

The power tool clamping device 10 additionally has at least one slotted link movement unit 20, which is provided, in at least one operating state, to move the clamping element 18 for the purpose of generating a tension in the sheet-type working tool 12. In this case, at least one slotted link movement element 22 of the slotted link movement unit 20 is disposed on the clamping element 18. The slotted link movement element 22 is realized as a slotted link guideway. In addition, the slotted link movement element 22 realized as a slotted link guideway is disposed in the guide region 60 of the clamping element 18. In this case, the slotted link movement element 22 realized as a slotted link guideway is realized as a recess in the guide region 60 of the clamping element 18, the recess being L-shaped. It is also conceivable, however, for the slotted link movement element 22 to be of a different design, considered appropriate by persons skilled in the art, such as, for example, a groove delimited by axial extensions disposed on the guide region 60, etc.

Moreover, the slotted link movement unit 20 has at least one further slotted link movement element 24, which is disposed on an operating element 26 of the clamping unit 16. The operating element 26 is realized as a pivotally mounted operating lever 28. An operating element pivot axis 96 runs at least substantially perpendicularly in relation to the working tool seating face 66. It is also conceivable, however, for the operating element pivot axis 96 to run along a different direction, considered appropriate by persons skilled in the art, such as, for example, along a direction running at least substantially parallelwise in relation to the working tool seating face 66. The further slotted link movement element 24 is realized as a slotted pin. When in a mounted state, the further slotted link movement element 24, realized as a slotted pin, engages in the slotted link movement element 22 that is realized as a slotted link guideway. In this case, edge regions of the slotted link movement element 22 that delimit the slotted link movement element 22 realized as a slotted link guideway are provided to guide the further slotted link movement element 24, realized as a slotted pin, upon a pivot movement of the operating element 26, in order to define a movement of the clamping element 18.

Figure 4A:
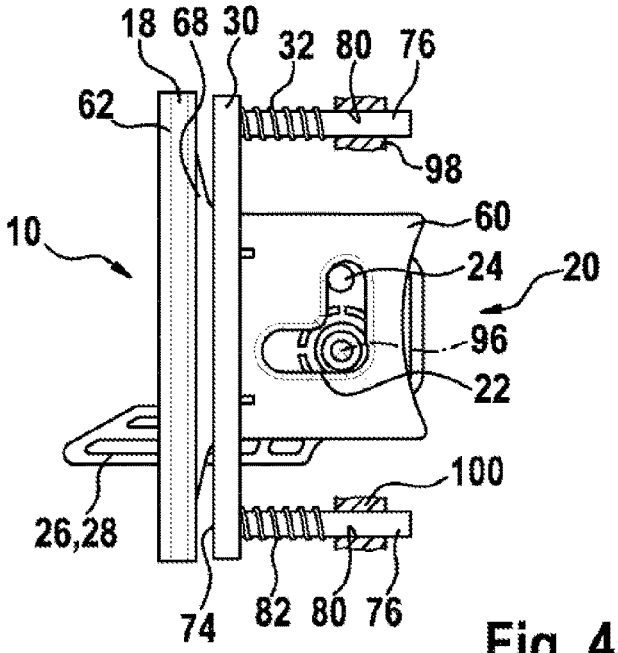
FIG. 4*a* shows a schematic representation of a detail view of the power tool clamping device according to the disclosure in an opened state.
Figure 4B:
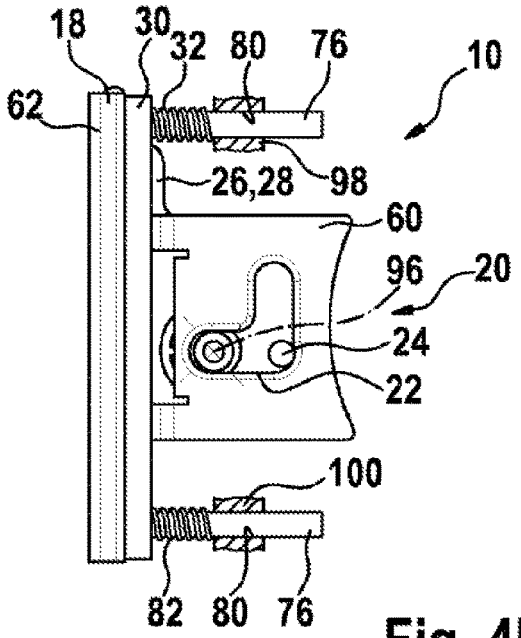
FIG. 4*b* shows a schematic representation of a detail view of the portable power tool according to the disclosure in a closed state.
Figure 5:
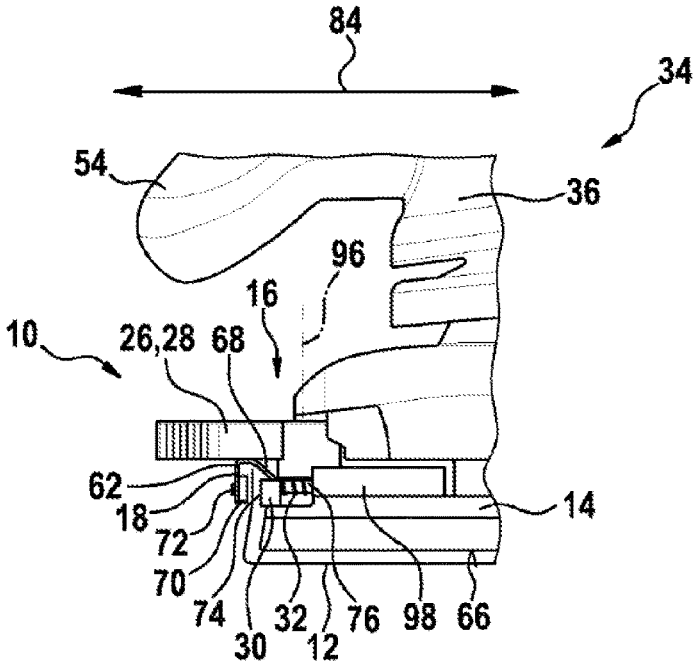
FIG. 5 shows a schematic representation of a detail view of the power tool clamping device according to the disclosure in an opened state, during an operation of inserting a sheet-type working tool into the power tool clamping device according to the disclosure.

For the purpose of mounting the sheet-type working tool 12, and end of the sheet-type working tool 12 is first clamped to the tool receiver 14 by means of the counter-clamping element 86, or clamped in between the binding jaw element 92 of the counter-clamping element and the binding face 94 of the tool receiver 14. The operating element 26, starting from a clamping position (FIG. 4*b*) in which a tension is generated in the sheet-type working tool 12 when the sheet-type working tool 12 is in a clamped state, is then pivoted about the operating element pivot axis 96 by an operator. This causes the further slotted link movement element 24, realized as a slotted pin, to slide on the edge regions of the slotted link movement element 22, thereby moving the clamping element 18 in a direction away from the tool receiver 14. Owing to a spring force of the spring elements 32, 82, the further clamping element 30 is likewise moved in the direction away from the tool receiver 14, since the clamping element 18 enables a movement capability of the further clamping element 30, because of the movement in the direction away from the tool receiver 14. The further clamping element 30 in this case continues to move in the direction away from the tool receiver 14 until the securing elements of the further clamping element 30, which are not represented, strike against a stop. The clamping element 18 continues to be moved in the direction away from the tool receiver 14, as a result of the combined action of the slotted link movement element 22 realized as a slotted link guideway, and of the further slotted link movement element 24, realized as a slotted pin, until the combined action of the slotted link movement element 22 realized as a slotted link guideway and of the further slotted link movement element 24, realized as a slotted pin, delimits the movement of the clamping element 18 (FIG. 4*a*). In this case, the binding jaw element 70 of the clamping element 18 is disposed at a distance relative to the binding jaw element 78 of the further clamping element 30, as viewed along a at least substantially perpendicularly in relation to the operating element pivot axis 96. When the further clamping element 30 and the movement of the clamping element 18 that is delimited by the combined action of the slotted link movement element 22 realized as a slotted link guideway and of the further slotted link movement element 24, realized as a slotted pin, are at an end stop, the clamping unit 16 is in an insertion state, in which a further end of the sheet-type working tool 12 that faces away from the end already clamped by means of the counter-clamping element 86 can be inserted between the binding jaw element 70 of the clamping element 18 and the binding jaw element 78 of the further clamping element 30 (FIG. 5).

Figure 6:
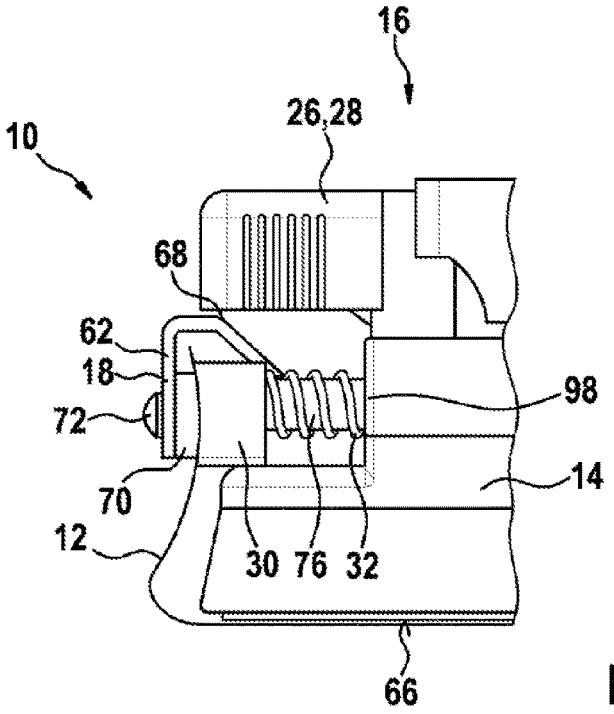
FIG. 6 shows a schematic representation of a detail view of the portable power tool according to the disclosure, with a clamping unit of the power tool clamping device according to the disclosure in a closed state.
Figure 7:
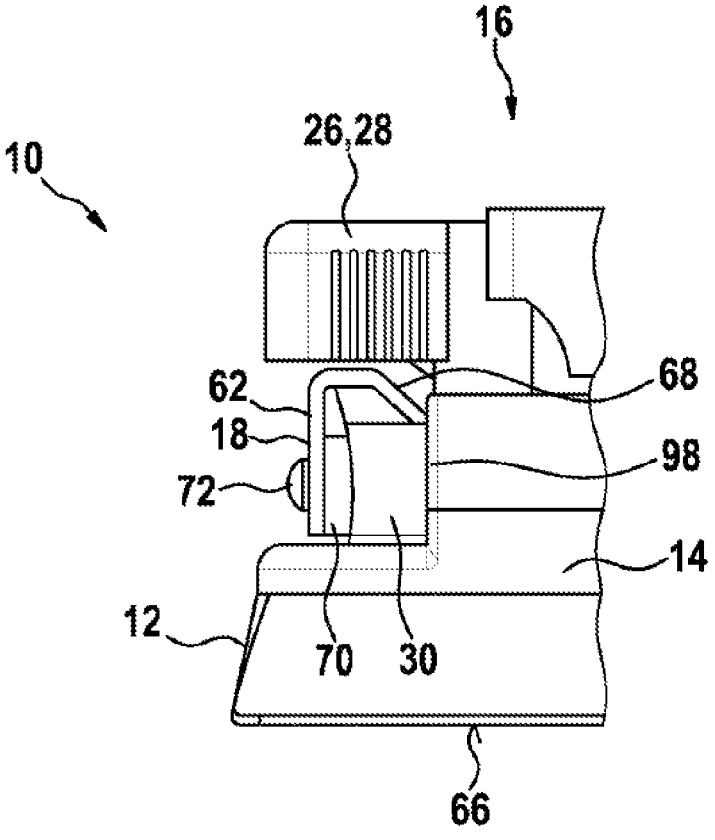
FIG. 7 shows a schematic representation of a detail view of the power tool clamping device according to the disclosure, with the sheet-type working tool in a clamped state in the power tool clamping device according to the disclosure.

For the purpose of clamping the end of the sheet-type working tool 12 that is inserted between the binding jaw element 70 of the clamping unit 18 and the binding jaw element 78 of the further clamping element 30, the operating element 26 is pivoted about the operating element pivot axis 96, in a direction opposite to the movement out of the clamping position. As a result of this, at the start of the pivot movement of the operating element 26, the clamping element 18 is moved in a direction toward the tool receiver 14, as a result of the combined action of the slotted link movement element 22 realized as a slotted link guideway and of the further slotted link movement element 24, realized as a slotted pin. The binding jaw element 70 of the clamping element 18 is thus moved in the direction of the binding jaw element 78 of the further clamping element 30. The end of the sheet-type working tool 12 that is inserted between the binding jaw element 70 of the clamping element 18 and the binding jaw element 78 of the further clamping element 30 is thus clamped in between the binding jaw element 70 of the clamping element 18 and the binding jaw element 78 of the further clamping element 30 (FIG. 6). Upon a further pivot movement of the operating element 26 about the operating element pivot axis 96, in the direction of the clamping position of the operating element 26, the further clamping element 30 is moved against a spring force of the spring elements 32, 82 of the clamping unit 16 by the clamping element 18, which is moved in the direction of the tool receiver 14 as a result of the combined action of the slotted link movement element 22 realized as a slotted link guideway and of the further slotted link movement element 24, realized as a slotted pin, until the further clamping element 30 bears against stop elements 98, 100 of the tool receiver 14 (FIG. 7), which are each constituted by the collar disposed in the guide recess 80. The stop elements 98, 100 in this case are realized so as to be integral with edge regions of the guide recesses 80, which edge regions each delimit the guide recesses 80 that receive the guide regions 76 of the further clamping element 30. In this case, the clamping element 18 and the further clamping element 30 are moved translationally along a distance of 6 mm, by means of the slotted link movement unit 20, for the purpose of clamping the sheet-type working tool 12. As a result of this, after the inserted end of the sheet-type working tool 12 has been clamped in between the binding jaw element 70 of the clamping element 18 and the binding jaw element 78 of the further clamping element 30, a tension is generated in the sheet-type working tool 12, which causes the sheet-type working tool 12 to bear in a taught manner against the working tool seating face 66 of the tool receiver 14. In this case, the sheet-type working tool 12 is moved over the step-type offset of the tool receiver 14 by means of the movement of the binding jaw element 70 of the clamping element 18 and the binding jaw element 78 of the further clamping element 30, at least substantially parallelwise in relation to the working tool seating face 66. The combined action of the slotted link movement element 22 realized as a slotted link guideway and of the further slotted link movement element 24, realized as a slotted pin then causes a movement of the clamping element 18, according to a toggle lever principle already known to persons skilled in the art. A large force for generating a tension in the sheet-type working tool 12 is thus achieved by means of a short movement path.

The invention claimed is:

1. A power tool clamping device for clamping a sheet-type working tool to a tool receiver that is mounted in an eccentrically movable manner, comprising:

at least one clamping element movably mounted to the tool receiver;

at least one slotted link movement unit configured to move the clamping element so as to generate a tension in the sheet-type working tool in at least one operating state; and a further clamping element mounted to the tool receiver so as to be movable relative to the at least one clamping element.

2. The power tool clamping device as claimed in claim 1, wherein the slotted link movement unit has at least one slotted link movement element disposed on the at least one clamping element.

3. The power tool clamping device as claimed in claim 2, wherein the at least one clamping element includes an operating element, and wherein the slotted link movement unit has at least one further slotted link movement element disposed on the operating element.

4. The power tool clamping device as claimed in claim 3, wherein the operating element is configured as a pivotally mounted operating lever.

5. The power tool clamping device as claimed in claim 1, wherein the at least one clamping element is mounted in a translationally movable manner.

6. The power tool clamping device as claimed in claim 1, wherein the further clamping element is mounted in a translationally movable manner.

7. The power tool clamping device as claimed in claim 1, wherein the at least one clamping element has at least one spring element configured to apply a spring force to the further clamping element in the direction of the at least one clamping element.

8. The power tool clamping device as claimed in claim 1, wherein the further clamping element is moved by the at least one clamping element against a spring force of a spring element of the at least one clamping element at least when in an operating state.

9. A portable power tool, comprising:

a power tool clamping device for clamping a sheet-type working tool to a tool receiver that is mounted in an eccentrically movable manner, the power tool clamping device including;

at least one clamping element movably mounted on the tool receiver;

at least one slotted link movement unit configured to move the clamping element so as to generate a tension in the sheet-type working tool in at least one operating state; and a further clamping element mounted to the tool receiver so as to be movable relative to the at least one clamping element.

10. The portable power tool as claimed in claim 9, wherein the portable power tool is configured as an orbital sander.

* * * * *